US006918840B2

(12) United States Patent
Stites et al.

(10) Patent No.: US 6,918,840 B2
(45) Date of Patent: Jul. 19, 2005

(54) GOLF CLUB HEAD HAVING A BRIDGE MEMBER

(75) Inventors: John Thomas Stites, Weatherford, TX (US); Michael G. Taylor, Granbury, TX (US); David N. Franklin, Granbury, TX (US); Byron Cole Slaughter, Granbury, TX (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 10/707,522

(22) Filed: Dec. 19, 2003

(65) Prior Publication Data

US 2004/0110575 A1 Jun. 10, 2004

Related U.S. Application Data

(63) Continuation of application No. PCT/IB03/05942, filed on Dec. 15, 2003, which is a continuation of application No. 10/666,346, filed on Sep. 19, 2003.

(51) Int. Cl.[7] ..... A63B 53/04

(52) U.S. Cl. ..... 473/291; 473/350

(58) Field of Search ..... 473/290–291, 473/349–350, 324; D21/747–752

(56) References Cited

U.S. PATENT DOCUMENTS

| | | | | |
|---|---|---|---|---|
| 3,989,248 | A | * 11/1976 | Campau | 473/329 |
| 4,826,172 | A | 5/1989 | Antonious | |
| 5,082,278 | A | 1/1992 | Hsien | |
| 5,264,533 | A | 11/1993 | Rehmer | |
| 5,282,625 | A | 2/1994 | Schmidt et al. | |
| 5,297,803 | A | * 3/1994 | Solheim | 473/350 |
| 5,328,184 | A | 7/1994 | Antonious | |
| 5,330,187 | A | 7/1994 | Schmidt et al. | |
| 5,333,872 | A | 8/1994 | Manning et al. | |
| 5,385,348 | A | 1/1995 | Wargo | |
| 5,395,113 | A | 3/1995 | Antonious | |
| 5,401,021 | A | 3/1995 | Allen | |
| 5,472,203 | A | 12/1995 | Schmidt et al. | |
| 5,484,146 | A | 1/1996 | Loschiaro | |
| D371,182 | S | 6/1996 | Stites | |
| 5,549,297 | A | 8/1996 | Mahaffey | |
| 5,584,770 | A | 12/1996 | Jensen | |
| 5,658,208 | A | 8/1997 | Shimasaki | |
| 5,738,596 | A | 4/1998 | Meyer | |
| 5,749,795 | A | 5/1998 | Schmidt et al. | |
| 5,873,795 | A | 2/1999 | Wozny et al. | |

(Continued)

FOREIGN PATENT DOCUMENTS

| | | |
|---|---|---|
| GB | 232563 | 3/1925 |
| GB | 2316011 | 2/1998 |
| GB | 2365785 | 2/2002 |
| JP | 09-135933 | 5/1997 |
| JP | 09-285576 | 11/1997 |

(Continued)

OTHER PUBLICATIONS

Ben Hogan Golf 2004, Edge CFT Hydris "h" Iron Set, Same Great Edge CFT Technology . . . Improved by Including Two CFT Hybrids, copyright Callaway Golf Company, 2004.
International Search Report, date Jun. 30, 2004, 5 pages.

*Primary Examiner*—Stephen Blau
(74) *Attorney, Agent, or Firm*—Banner & Witcoff, Ltd.

(57) ABSTRACT

A cavity back golf club head having a bridge member is disclosed. The bridge member extends across a first rear cavity connecting a heel and a toe of the golf club head to control the trajectory of a golf ball. For the longer iron clubs, a wall extending from the sole portion of the cavity back golf club head to the bridge member defines a second cavity to further influence the trajectory of the golf ball. For the shorter iron clubs, the wall extends from the top portion of the cavity back golf club head to the bridge member

16 Claims, 4 Drawing Sheets

U.S. PATENT DOCUMENTS

| | | | | |
|---|---|---|---|---|
| 5,916,042 | A | 6/1999 | Reimers | |
| 6,015,354 | A | 1/2000 | Ahn et al. | |
| 6,030,295 | A | 2/2000 | Takeda | |
| 6,045,456 | A | 4/2000 | Best et al. | |
| 6,077,173 | A | 6/2000 | Stites | |
| 6,080,069 | A | 6/2000 | Long | |
| 6,210,290 | B1 | 4/2001 | Erickson et al. | |
| 6,277,032 | B1 | 8/2001 | Smith | |
| 6,280,348 | B1 | 8/2001 | Stites | |
| 6,290,607 | B1 | 9/2001 | Gilbert et al. | |
| 6,315,678 | B1 | 11/2001 | Teramoto | |
| 6,406,382 | B1 * | 6/2002 | Deshmukh et al. | 473/349 |
| 6,450,897 | B2 | 9/2002 | Stites | |
| 6,592,469 | B2 | 7/2003 | Gilbert | |
| D488,203 | S | 4/2004 | Madore et al. | |
| 2001/0055996 | A1 * | 12/2001 | Iwata et al. | 473/350 |
| 2003/0199331 | A1 | 10/2003 | Stites | |
| 2003/0203764 | A1 * | 10/2003 | Dabbs et al. | 473/291 |
| 2003/0228928 | A1 | 12/2003 | Masanori | |

FOREIGN PATENT DOCUMENTS

| | | |
|---|---|---|
| JP | 10-005377 | 1/1998 |
| JP | 11-047322 | 2/1999 |
| JP | 2000005356 | 1/2000 |
| JP | 2000005357 | 1/2000 |
| JP | 2000093566 | 4/2000 |
| JP | 200210400 | 8/2000 |
| JP | 2000334073 | 12/2000 |
| JP | 2000345204 | 12/2000 |
| JP | 2001009070 | 1/2001 |
| JP | 2001046560 | 2/2001 |
| JP | 2001079124 | 3/2001 |
| JP | 2001087430 | 4/2001 |
| JP | 2001161870 | 6/2001 |
| JP | 2001190720 | 7/2001 |
| JP | 2001204863 | 7/2001 |
| JP | 2001314535 | 11/2001 |
| JP | 2002143355 | 5/2002 |
| JP | 2002186696 | 7/2002 |
| JP | 2002191729 | 7/2002 |
| JP | 2002253710 | 9/2002 |
| JP | 2003062132 | 3/2003 |
| WO | WO 93/15151 | 8/1993 |

* cited by examiner

GOLF CLUB HEAD HAVING A BRIDGE MEMBER

CROSS REFERENCE TO RELATED APPLICATIONS

This application is a continuation of International application serial No. PCT/IB03/05942, filed on Dec. 15, 2003, which claims priority to, and is a continuation of U.S. application Ser. No. 10/666,346, filed on Sep. 19, 2003.

BACKGROUND OF INVENTION

1. Field of the Invention

The present invention relates to golf club heads. More particularly, the invention concerns cavity back golf club heads having a bridge member extending across a first rear cavity. The invention provides a second rear cavity connecting the bridge member to either the sole or top portion of the golf club head.

Various golf club heads have been designed to improve a golfer's accuracy by assisting a golfer to square the club head face at impact with a golf ball. A number of these golf club heads reposition the weight of the golf club head in order to alter the location of the center of gravity. The location of the center of gravity of the golf club head is one factor that determines whether a golf ball is propelled in the intended direction. When the center of gravity is positioned behind the point of engagement on the contact surface, the golf ball follows a generally straight route. When the center of gravity is spaced to a side of the point of engagement, however, the golf ball may follow a route that curves left or right, which is often referred to as a hook or a slice. Similarly, when the center of gravity is spaced above or below the point of engagement, the route of the golf ball may exhibit a boring or climbing trajectory.

Golf club heads such as the cavity back club heads assist the golfer by locating the weight of the golf club head around the golf club head perimeter. Generally, these golf club heads are more forgiving than non-cavity golf club heads thereby allowing a golf ball to be struck off center or miss-hit, while still providing relatively good distance and accuracy. The control of the trajectory of a golf ball is limited by the limited control over the center of gravity of a golf club head. Therefore, there is a need in the art for a golf club head that repositions additional weight away from the golf club head face to further shift the center of gravity of a golf club head.

SUMMARY OF INVENTION

One or more of the above-mentioned needs in the art are satisfied by the disclosed golf club head of the present invention. The cavity back golf club head of the present invention may include a bridge member where the center of gravity is located between the bridge member and the rear of the club head face. The bridge member provides additional weight towards the rear of the club head to shift the center of gravity of the golf club head further behind the point of engagement. The shifting of weight towards the rear of the golf club head influences the trajectory of the ball upon impact.

In a first embodiment of the invention, a golf club head comprises a heel, a toe, a top portion, and a sole portion. The cavity golf club head further includes a bridge member extending across a first rear cavity connecting the heel and the toe of the golf club head. A wall extending from the sole portion of the golf club head to the bridge member forms a second rear cavity. The second rear cavity and the bridge member vary the center of gravity of then golf club head with respect to the striking face to influence the trajectory of a golf ball.

In a second embodiment of the invention, a golf club head comprises a heel, a toe, a top portion, and a sole portion. The cavity golf club head further includes a bridge member extending across a first rear cavity connecting the heel and the toe of the golf club head. A wall extending from the top portion of the golf club head to the bridge member forms a second rear cavity. The second rear cavity and the bridge member vary the center of gravity of the golf club head with respect to the striking face to influence the trajectory of a golf ball.

In a third embodiment of the invention, a long iron cavity back golf club head includes a body having a toe, a heel, a top portion, a sole portion, a striking face, and a rear face opposite the striking face. The long iron cavity back golf club head also includes a first rear cavity and a single bridge member extending across the first rear cavity connecting the toe to the heel. A second rear cavity is defined by a wall connecting the bridge member to the sole portion of the long iron cavity back golf club head, the second rear cavity and the single bridge member varying a center of gravity of the long iron cavity back golf club head with respect to the striking face to influence the trajectory of a golf ball.

In yet another embodiment, a short iron cavity back golf club head includes a body having a toe, a heel, a top portion, a sole portion, a striking face, and a rear face opposite the striking face. The short iron cavity back golf club head also includes a first rear cavity and a single bridge member extending across the first rear cavity connecting the toe to the heel. A wall connecting the single bridge member to the top portion of the short iron cavity back golf club head defines a second rear cavity. The second rear cavity and the single bridge member vary a center of gravity of the short iron cavity back golf club head with respect to the striking face to influence the trajectory of a golf ball.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

BRIEF DESCRIPTION OF DRAWINGS

The present invention is illustrated by way of example and not limited in the accompanying figures in which like reference numerals indicate similar elements and in which.

DETAILED DESCRIPTION

The following discussion and accompanying figures disclose various golf club heads in accordance with the present invention. For example, the golf club heads of the present invention can be utilized for the long iron clubs, two iron through five iron, and for the short iron clubs, six iron through pitching wedge. In the current description of the invention, FIGS. 1–5 are representative of the long iron clubs including the present invention, whereas, FIGS. 6–10 are representative of the short iron clubs including the present invention.

Figure 1:
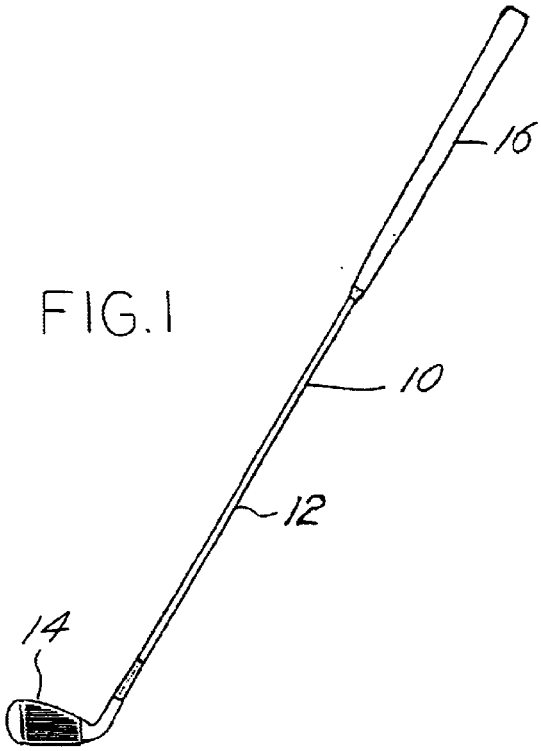
FIG. 1 illustrates an elevational view of a golf club having a golf club head in accordance with the present invention.

Referring to FIG. 1, golf club 10 includes a shaft 12 and a golf club head 14. The golf club head 14 of FIG. 1 may be representative of a two iron golf club head of the present invention. The shaft 12 of golf club 10 may be made of various materials such as steel, titanium, graphite, or a composite material. A grip 16 is positioned on the shaft 12 to provide a golfer with a slip resistant surface in which to grasp golf club 10.

Figure 2:
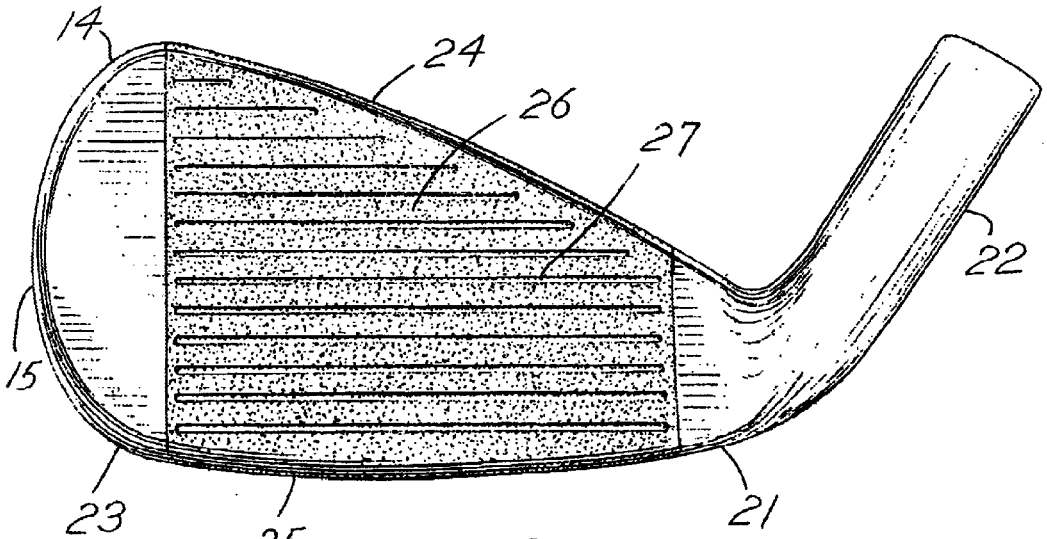
FIG. 2 illustrates a front view of a golf club head in accordance with the present invention.

As shown in FIG. 2, the golf club head 14 comprises a body 15 that includes a heel 21 and toe 23. The heel 21 is attached to a hosel 22 for connecting the shaft 12 of FIG. 1 to the golf club head 14. The body 15 also includes a top portion 24 and a sole portion 25. A striking face 26 is connected between the top portion 24 and the sole portion 25, and between the toe 23 and the heel 21. The striking face 26 provides a contact area for engaging and propelling a golf ball in an intended direction. The striking face 26 comprises horizontal grooves 27 for the removal of water and grass from the striking face 26. The body 15 of golf club head 14 may be constructed of various materials such as steel, titanium, aluminum, tungsten, graphite, polymers, or composites.

Figure 3:
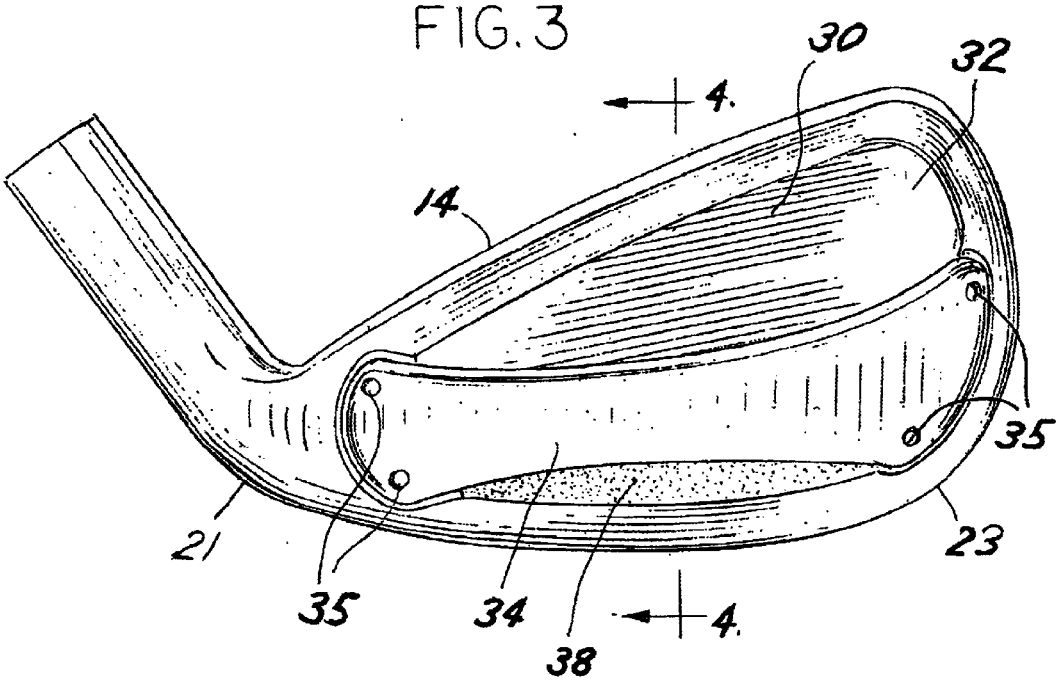
FIG. 3 illustrates a rear view of a golf club head in accordance with the present invention.

FIG. 3 illustrates a rear view of a golf club head 14. Golf club head 14 of the present invention includes a rear face 30 positioned opposite the striking face 26. The rear face 30 forms a first rear cavity 32 having a large opening extending towards the rear face 30. A bridge member 34 extends across the first rear cavity 32 which may connect the heel 21 to the toe 23. Bridge member 34 may also be extended across the first rear cavity 32 and connected to various other locations on the golf club head 14 as shown, for example, in U.S. Pat. No. 6,450,897 issued on Sep. 17, 2002, which is hereby incorporated by reference in its entirety. Bridge member 34 may be made of various shapes such as rectangle, oval, triangle, trapezoid, square or other symmetrical or asymmetrical shapes. Bridge member 34 may also have a non-uniform width or thickness throughout its length.

Bridge member 34 may be connected to the toe 23 and heel 21 using screws 35. Those skilled in the art will realize that bridge member 34 may be connected to the toe 23 and the heel 21 using fewer or additional connection points and through numerous other connection means which fall within the scope of the present invention. For example, bridge member 34 may also be formed with the golf club head 14 in a single casting making the bridge member 34 integral with the golf club head 14.

Figure 4:
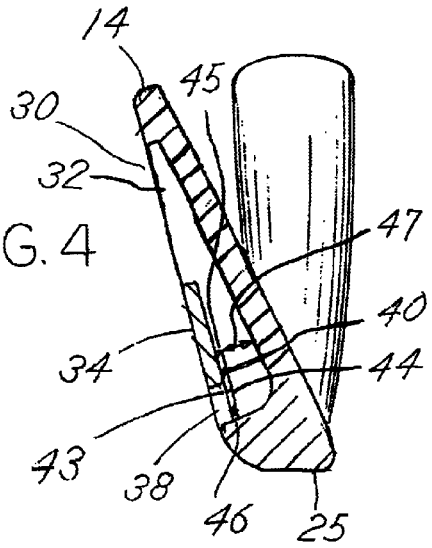
FIG. 4 illustrates a cross-sectional view of a golf club head in accordance with the present invention.

A second rear cavity 38 is shown in FIG. 3 below the bridge member 34. With reference to FIG. 4, a cross-sectional view of golf club head 14 is illustrated. A wall 40 extends from the sole portion 25 to the bridge member 34. The wall 40 creates the second rear cavity 38 having an opening positioned below bridge member 34. The wall 40 may comprise a front surface 43, a back surface 44, a top surface 45, and a bottom surface 46. A space 47 may exist between back surface 44 of wall 40 and the rear face 30 of the golf club head 14.

Wall 40 may be integrally formed with the club head 14 and bridge member 34 to provide additional support and stiffness to bridge member 34. Wall 40 may be linear or curved depending upon the shape of bridge member 34. The integrally formed club head 14, wall 40, and bridge member 34 may be made of various materials such as stainless steel, titanium, graphite, plastic, or a composite material. The additional support and stiffness to bridge member 34 may prevent any deformation of bridge member 34 upon contact with a golf ball. In addition, the wall 40 may provide a vibration damping effect upon impact of striking face 26 with a golf ball.

In another embodiment, the front surface 43 and the bottom surface 46 of wall 40 may be secured to the bridge member 34 and sole portion 25 using an adhesive. Those skilled in the art will realize that numerous other ways exist to attach front surface 43 and bottom surface 46 to the bridge member 34 and sole portion 25, respectively. These numerous other ways of attachment are contemplated and fall within the scope of the present invention.

During the game of golf, an individual holds grip 16 and swings golf club 10 such that golf club head 14 traverses a generally arcuate path and impacts a golf ball. A portion of the inertia of golf club 10, and particularly the inertia of golf club head 14, is then transferred to the golf ball and propels the golf ball toward an intended target. The position of a center of gravity of head 14 has an influence upon whether the golf ball curves right, curves left, or follows a generally straight route. More specifically, the golf ball follows a generally straight route when the center of gravity is positioned behind the point of engagement on striking face 26. When the center of gravity is spaced to one side of the point of engagement, however, the golf ball may follow a route that curves left or right. The position of the center of gravity of golf club head 14 also has an influence upon whether the golf ball exhibits a boring or climbing trajectory, depending upon whether the center of gravity is spaced above or below the point of engagement on striking face 26.

Although the concepts behind utilizing a golf club to propel a golf ball toward an intended target appear simplistic, the actual practice of propelling the golf ball in an intended manner is exceedingly complex. The golf ball may, for example, consistently curve right when, in fact, the individual intends to propel the golf ball along a straight route. Many conventional golf club heads have a center of gravity located at the striking face 26. However, changing the position of the center of gravity of the golf club head 14 for different golf clubs may assist many golfers in squaring the club head face 14 upon impact with a golf ball. The positioning of the center of gravity off of the striking face 26 and towards the rear of the golf club head 14 may conform to the style and preferences of many golfers. Accordingly, these golfers may be able to correct or modify the route of the golf ball by using the golf club head 14 of the present invention as the center of gravity of golf club head 14 is repositioned with respect to striking face 26 as compared to other golf club heads.

The center of gravity of golf club head 14, otherwise referred to as the center of mass, is defined as an equilibrium point. More specifically, the center of gravity of golf club head 14 is a point at which the entire weight of golf club head 14 may be considered as concentrated so that, if supported at that point, head 14 would remain in static equilibrium in any position. The center of gravity of golf club head 14 may be changed by altering the weight distribution of the golf club head 14 away from the striking face 26. Altering the weight distribution of golf club head 14 may be accomplished with the use of bridge member 34 and wall 40.

Bridge member 34 increases the weight of the back of the golf club head 14 relative to the striking face 26 of the golf club head 14. This increase in weight towards the rear of golf club head 14 alters the center of gravity of golf club head 14. By moving the center of gravity lower and towards the rear of the golf club head, the golf club 10 will tend to have an increased loft upon impact. In addition, the shape and location of bridge member 34 may also influence the location of the center of gravity of golf club head 14. For example, on the longer iron clubs, two iron through five iron, it is desirable to have the center of gravity lower than on the shorter iron clubs. On the longer iron clubs, a lower center of gravity will assist a golfer with obtaining additional loft on their golf shot. The bridge member 34 for longer iron clubs is positioned lower on the rear of the golf club head body 14 as compared to a bridge member on a shorter iron club.

The lowering of the center of gravity of the golf club head 14 may also be accomplished through the use of wall 40. Wall 40 increases the weight of the back of the golf club head 14 relative to the striking face 26. This increase in weight to the back of golf club head 14 relative to the striking face 26 lowers the center of gravity of golf club head 14, thus allowing the golf club head to propel a golf ball with a higher trajectory. In addition, wall 40 increases the support of bridge member 34 and may prevent any deformation of bridge member 34 upon contact with a golf ball. The added support may tend to increase the distance that the golf ball travels upon impact. In addition, the wall 40 may provide a vibration damping effect upon the impact of striking face 26 with a golf ball.

Figure 5:
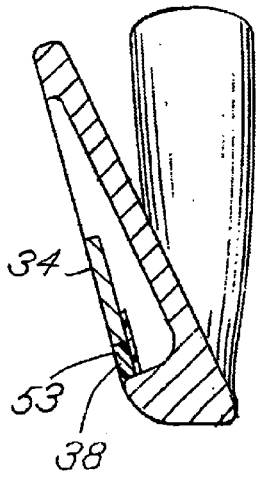
FIG. 5 illustrates another cross-sectional view of a golf club head in accordance with the present invention.

With reference to FIG. 5, the position of the center of gravity may also be modified by placing a material in the second rear cavity 38 to fill the rear cavity 38. The material to fill the second rear cavity 38 may include an epoxy or a high density material such as tungsten 53. In addition, the material used to fill the second rear cavity may also comprise a vibration damping material. By filling the second rear cavity 38, the position of a center of gravity of the golf club head with respect to the striking face is varied. In particular, the center of gravity of golf club head 14 relative to the striking face 26 is lowered assisting the golfer to obtain additional loft of the golf shot.

Figure 6:
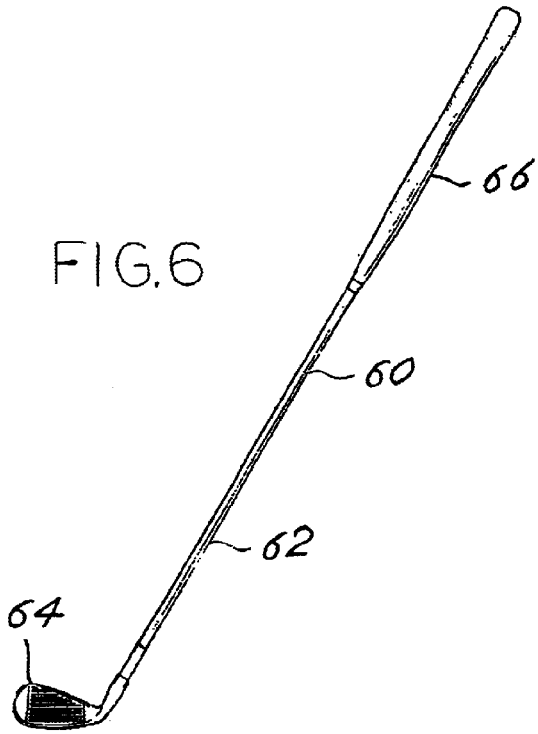
FIG. 6 illustrates an elevational view of another embodiment of a golf club having a head in accordance with the present invention.

In another embodiment of the invention, FIG. 6 illustrates a golf club 60 that includes a shaft 62 and a golf club head 64 similar to FIG. 1. The golf club head 64 of FIG. 6 may be representative of a pitching wedge of the present invention. The shaft 62 of golf club 60 may be made of various materials such as steel, titanium, graphite, or a composite material. A grip 66 is positioned on the shaft 62 to provide a golfer with a slip resistant surface in which to grasp the golf club 60.

Figure 7:
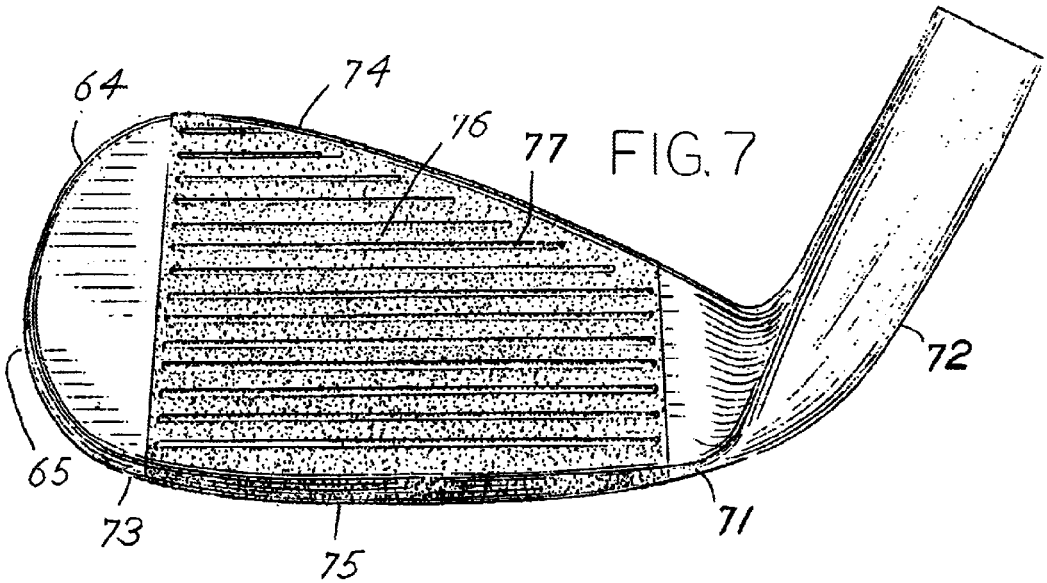
FIG. 7 illustrates a front view of another embodiment of a golf club head in accordance with the present invention.

As shown in FIG. 7, the golf club head 64 comprises a body 65 that includes a heel 71 and toe 73. The heel 71 is attached to a hosel 72 for connecting the shaft 62 of FIG. 6 to the golf club head 64. The body 65 also includes a top portion 74 and a sole portion 75. A striking face 76 is connected between the top portion 74 and the sole portion 75, and between the toe 73 and the heel 71. The striking face 76 provides a contact area for engaging and propelling a golf ball in an intended direction. The striking face 76 comprises horizontal grooves 77 for the removal of water and grass from the striking face 76. The body 75 of golf club head 64 may be constructed of various materials such as steel, titanium, aluminum, tungsten, graphite, polymers, or composites.

Figure 8:
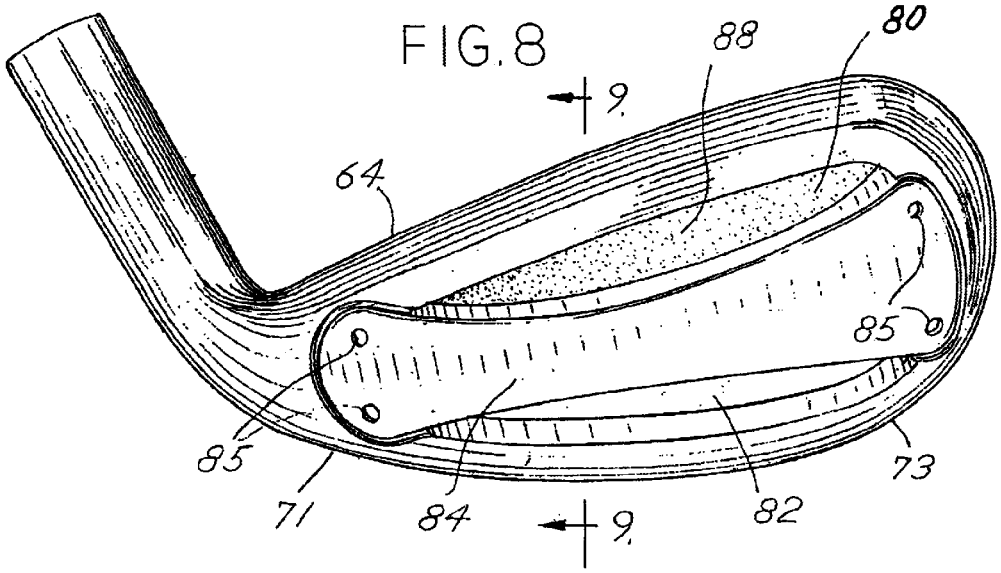
FIG. 8 illustrates a rear view of another embodiment of a golf club head in accordance with the present invention.

FIG. 8 illustrates a rear view of a golf club head 64. Golf club head 64 of the present invention includes a rear face 80 positioned opposite the striking face 76. The rear face 80 forms a first rear cavity 82 having a large opening extending towards rear face 80. A bridge member 84 extends across the first rear cavity 82 connecting the heel 71 to the toe 73. Bridge member 84 may also be extended across the first rear cavity 82 and connected to various other locations on the golf club head 64 as shown, for example, in U.S. Pat. No. 6,450,897 issued on Sep. 17, 2002, which is hereby incorporated by reference in its entirety. Bridge member 84 may be made of various shapes such as rectangle, oval, triangle, trapezoid, square or other symmetrical or asymmetrical shapes. Bridge member 84 may also have a non-uniform width or thickness throughout its length.

Bridge member 84 may be connected to the toe 73 and heel 71 using screws 85. Those skilled in the art will realize that bridge member 84 may be connected to the toe 73 and the heel 71 using fewer or additional connection points and through numerous other connection means which fall within the scope of the present invention. For example, bridge member 84 may also be formed with the golf club head 64 in a single casting making the bridge member 84 integral with the golf club head 64.

Figure 9:
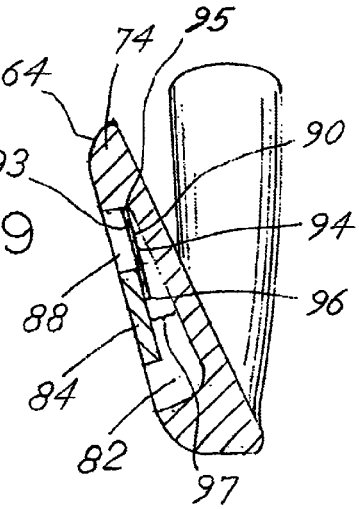
FIG. 9 illustrates a cross-sectional view of another embodiment of a golf club head in accordance with the present invention.

A second rear cavity 88 is illustrated in FIG. 8 above the bridge member 84. With reference to FIG. 9, a cross-sectional view of golf club head 64 is illustrated. A wall 90 extends from the top portion 74 to the bridge member 84. The wall 90 creates the second rear cavity 88 having an opening positioned above bridge member 84. The wall 90 may comprise a front surface 93, a back surface 94, a top surface 95, and a bottom surface 96. A space 97 may exist between back surface 94 of wall 90 and the rear face 80 of the golf club head 64.

Wall 90 may be integrally formed with the club head 64 and bridge member 84 to provide additional support and stiffness to bridge member 84. Wall 90 may be linear or curved depending upon the shape of bridge member 84. The integrally formed club head 64, wall 90, and bridge member 84 may be made of various materials such as stainless steel, titanium, graphite, plastic, or a composite material. The additional support and stiffness to bridge member 84 may prevent any deformation of bridge member 84 upon contact with a golf ball. In addition, the wall 90 may provide a vibration damping effect upon impact of striking face 76 with a golf ball.

In another embodiment, front surface 93 and the top surface 95 of wall 90 may be secured to the bridge member 84 and top portion 74 using an adhesive. Those skilled in the art will realize that numerous other ways exist to attach front surface 93 and top surface 95 to the bridge member 84 and top portion 74, respectively. These numerous other ways of attachment are contemplated and fall within the scope of the present invention.

Bridge member 84 increases the weight of the back of the golf club head 64 relative to the striking face 76 of the golf club head 64. This increase in weight towards the rear of golf club head 64 alters the center of gravity of golf club head 64. By moving the center of gravity higher and towards the rear of the golf club head, a golf ball may be propelled with a lower and more controlled trajectory.

The shape and location of bridge member 84 may also influence the location of the center of gravity of golf club head 64. For example, on the shorter iron clubs, six iron through pitching wedge, it is desirable to have the center of gravity higher than on the longer iron clubs. On the shorter iron clubs, a higher center of gravity will enable a golfer to have greater control over the flight of the golf ball. The bridge member 84 for shorter iron clubs is positioned higher on the rear of the golf club head body 64 as compared to a bridge member on longer iron clubs.

The raising of the center of gravity of golf club head 64 may also be accomplished though the use of wall 90. Wall 90 increases the weight on the back of the golf club head 64 relative to the striking face 76. This increase in weight to the back of golf club head 64 relative to the striking face 76 raises the center of gravity of golf club head 64 allowing the golf club head to propel a golf ball with a lower and more controlled trajectory.

Figure 10:
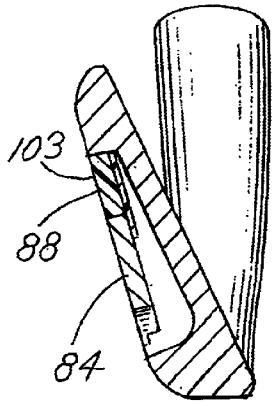
FIG. 10 illustrates another cross-sectional view of another embodiment of a golf club head in accordance with the present invention.

With reference to FIG. 10, the position of the center of gravity may also may modified by placing a material in the second rear cavity 88 in order to fill second rear cavity 88. The material to fill the second rear cavity 88 may include an epoxy or a high density material such as tungsten 103. In addition, the material used to fill the second rear cavity 88 may also comprise a vibration damping material. By filling the second rear cavity 88, the position of a center of gravity of the golf club head 64 with respect to the striking face 76 is varied. In particular, the center of gravity of golf club head 64 relative to the striking face 76 is raised providing the golf club with a lower initial loft at impact with a golf ball.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

We claim:

1. A golf club head comprising:

a heel;

a toe;

a top portion;

a sole portion;

a striking face extending from the top portion to the sole portion, the striking face providing a contact area for engaging a golf ball;

a rear face opposite the striking face, the rear face defining a first rear cavity;

a bridge member extending across the first rear cavity; and a wall extending from the top portion to the bridge member, the wall forming a second rear cavity, the second rear cavity located between the bridge member and the top portion, the second rear cavity including an epoxy, the second rear cavity including the epoxy and the bridge member varying a center of gravity of the golf club head with respect to the striking face.

2. The golf club head of claim 1, wherein the golf club head further comprises a space between the rear face and the wall.

3. The golf club head of claim 1, wherein the wall comprises a plastic.

4. The golf club head of claim 1, wherein the wall is integrally formed with the top portion.

5. The golf club head of claim 1, wherein the bridge member connects the toe and the heel.

6. A short iron cavity back golf club head, the short iron cavity back golf club head comprising:

a body having a toe, a heel, a top portion, a sole portion, a striking face, a rear face opposite the striking face;

a single bridge member extending across a first rear cavity; and a second rear cavity, the second rear cavity defined by a wall, the wall connecting the bridge member to the top portion of the short iron cavity back golf club head, the second rear cavity including an epoxy, the second rear cavity including the epoxy and the single bridge member varying a center of gravity of the short iron cavity back golf club head with respect to the striking face.

7. The short iron cavity back golf club head of claim 6, wherein the short iron cavity back golf club head comprises a six iron.

8. The short iron cavity back golf club head of claim 6, wherein the short iron cavity back golf club head comprises a seven iron.

9. The short iron cavity back golf club head of claim 6, wherein the short iron cavity back golf club head comprises an eight iron.

10. The short iron cavity back golf club head of claim 6, herein the short iron cavity back golf club head comprises a nine iron.

11. The short iron cavity back golf club head of claim 6, wherein the short iron cavity back golf club head comprises a pitching wedge.

12. The short iron cavity back golf club head of claim 6, wherein the wall comprises a plastic.

13. The short iron cavity back golf club head of claim 6, wherein the wall is integrally formed with the top portion.

14. The short iron cavity back golf club head of claim 6, wherein the wall connecting the bridge member to the top portion comprises a curve.

15. The short iron cavity back golf club head of claim 6, wherein the single bridge member connects the toe and the heel.

16. A golf club head comprising:

a heel;

a toe;

a top portion;

a sole portion;

a striking face extending from the top portion to the sole portion, the striking face providing a contact area for engaging a golf ball;

a rear face opposite the striking face, the rear face defining a first rear cavity;

a bridge member extending across the first rear cavity, the bridge member connecting the heel and the toe; and a wall extending from the top portion to the bridge member, the wall spaced apart from the rear face, the wall forming a second rear cavity, the second rear cavity including an epoxy, the second rear cavity including the epoxy and the bridge member varying a center of gravity of the golf club head with respect to the striking face.

* * * * *